US006182591B1

(12) United States Patent
Whitesides et al.

(10) Patent No.: US 6,182,591 B1
(45) Date of Patent: Feb. 6, 2001

(54) REINFORCED POWERBOAT CONSTRUCTION

(75) Inventors: Robert B. Whitesides, Murrysville; Janet C. Swearingen, Delmont; Frank A. DiCocco, Gibsonia, all of PA (US)

(73) Assignee: Alcoa Inc., Pittsburgh, PA (US)

( * ) Notice: Under 35 U.S.C. 154(b), the term of this patent shall be extended for 0 days.

(21) Appl. No.: 09/439,389

(22) Filed: Nov. 15, 1999

(51) Int. Cl.[7] ..... B63B 3/00
(52) U.S. Cl. ..... 114/83; 114/364; 114/355
(58) Field of Search ..... 114/83, 355, 356, 114/357, 364

(56) References Cited

U.S. PATENT DOCUMENTS 1,915,160 * 6/1933 Gray ..... 114/79 W
2,585,344 * 2/1952 Plaziak ..... 114/356
4,214,332 * 7/1980 Stoner ..... 114/356
4,892,054 * 1/1990 Davidson ..... 114/357
5,111,767 * 5/1992 Haines ..... 114/288
5,277,145 * 1/1994 Hordis ..... 114/357
5,690,048 * 11/1997 Friesen et al. ..... 114/356
5,758,594 * 6/1998 Siewert ..... 114/357

* cited by examiner

*Primary Examiner*—S. Joseph Morano
*Assistant Examiner*—Andrew D. Wright
(74) *Attorney, Agent, or Firm*—Arnold B. Silverman; Charles Q. Buckwalter

(57) ABSTRACT

A powerboat has a hull, keel, a transom, sidewalls, and a gunwale. The hull has at least one stringer on each side of the keel. An upwardly generally transversely oriented elongated structural member is secured to the transom. A lower generally transversely oriented structural member is secured to the transom in generally underlying relationship with respect to the upper generally transversely oriented structural member. At least one generally vertically oriented structural member is secured to the upper and lower transversely oriented structural members. The upper transversely oriented structural member serves to transfer a load from the transom to the gunwales. The lower transversely oriented structural member serves to transfer load from the transom to the keel and stringers. The powerboat may be a performance boat having the hull composed of outer and inner layers of aluminum skin with an interposed resinous foam material or a single plate.

28 Claims, 6 Drawing Sheets

REINFORCED POWERBOAT CONSTRUCTION

BACKGROUND OF THE INVENTION

1. Field of the Invention

The present invention relates to a reinforced powerboat construction and more specifically it relates to such a construction wherein structural members are provided to facilitate the transfer of loads applied to one portion of the boat, such as the transom to other portions of the powerboat.

2. Description of the Preferred Embodiments

As employed herein, the term "performance boat" shall mean noncommercial boats equipped with outboard marine engines or inboard-outboard marine engines having a horsepower in excess of 100 and are up to about 30 feet in overall length. Such boats are frequently used by competition fishermen to get from a starting point to the area where fishing will be initiated, as well as numerous other uses.

Such performance boats may take the form of runabouts, ski boats, and fishing boats. For example, the fishing boat may be generally similar with the bass boat having a lower gunwale than the walleye boat. It has been known to provide such boats with a length of about 10 to 30 feet, for example. It has also been known to construct such boats with a hull made from a single layer of aluminum with a transom composed of a sandwich panel consisting of an interior aluminum skin, an exterior aluminum skin and an interposed plywood layer. Such constructions distribute loads applied to the transom to the hull and sidewalls of the boat. The use of single layer aluminum construction generally requires a relatively thick aluminum material which may be in excess of 0.080 inch.

It is known that among the functions of the boat transom are to distribute the tensile, compressive, shear and torsional loads developed by high performance outboard marine engines to other areas of the boat.

The transom is not only subjected to loads imposed by the weight and thrust of the outboard or outboard-inboard marine engine, but also must effectively handle loads imposed by the powerboat moving at high rates of speed and the associated water and air forces imposed on the boat.

In spite of the previously known constructions, there remains a real and substantial need for an improved performance boat transom wherein loads are more efficiently distributed to other portions of the boat.

SUMMARY OF THE INVENTION

The present invention has met the above-described need by providing a powerboat which has a hull, a keel, a transom, sidewalls and a gunwale. The hull has a keel and at least one stringer on each side of the keel. The stringers are preferably oriented generally longitudinally. An upper generally transversely oriented structural member is secured to the transom and is in load transmitting relationship with respect to the gunwales. A lower generally transverse structural member is disposed generally in underlying relationship with respect to the upper structural member and is in load transmitting relationship with respect to the keel and stringers. At least one generally vertical structural member is secured to the upper and lower structural members.

The structural members may be composed of aluminum and are preferably hollow. The structural members may be aluminum extrusions, formed aluminum, or roll formed aluminum, for example.

It is an object of the present invention to provide a powerboat transom which has structural reinforcement in order to distribute load imposed on the transom to other portions of the powerboat.

It is a further object of the present invention to effect such distribution in a performance boat such that the load will be delivered to the gunwales, the keel and stringers.

It is a further object of the present invention to accomplish these objectives while reducing the thickness of the aluminum skin in an aluminum skin-resinous foam-aluminum skin sandwich construction.

It is yet another object of the present invention to provide such a construction which is compatible with existing powerboats such as runabouts, ski boats, and high performance fishing boats, for example.

It is a further object of the present invention to provide such a construction which will not only effectively deliver static loads applied to the transom by marine engines, but also dynamic loading resulting from high speed movement or accelerating or deceleration of the boat through the water with substantial air impingement on the boat hull.

It is a further object of the present invention to provide sufficient reinforcement to the powerboat as to resist undesired transient or permanent deformation of the boat hull during boat movement.

These and other objects of the invention will be more fully understood from the following description of the invention on reference to the illustrations appended hereto.

DESCRIPTION OF THE PREFERRED EMBODIMENTS

As used herein, the term "secured" or "secured to," unless a particular usage expressly states a contrary meaning, shall mean that a first structural member is secured to another structural member directly or indirectly so long as the desired functional relationship is achieved.

A performance powerboat may, for example, have an outboard or inboard-outboard marine engine having about 100 to 300 horsepower. Such an engine may weigh in excess of 500 pounds. Depending upon the boat size, hull configuration, marine engine size and other variables, such as water and wind conditions, the boat may be capable of moving at speeds of greater than 70 miles per hour.

Figure 1:
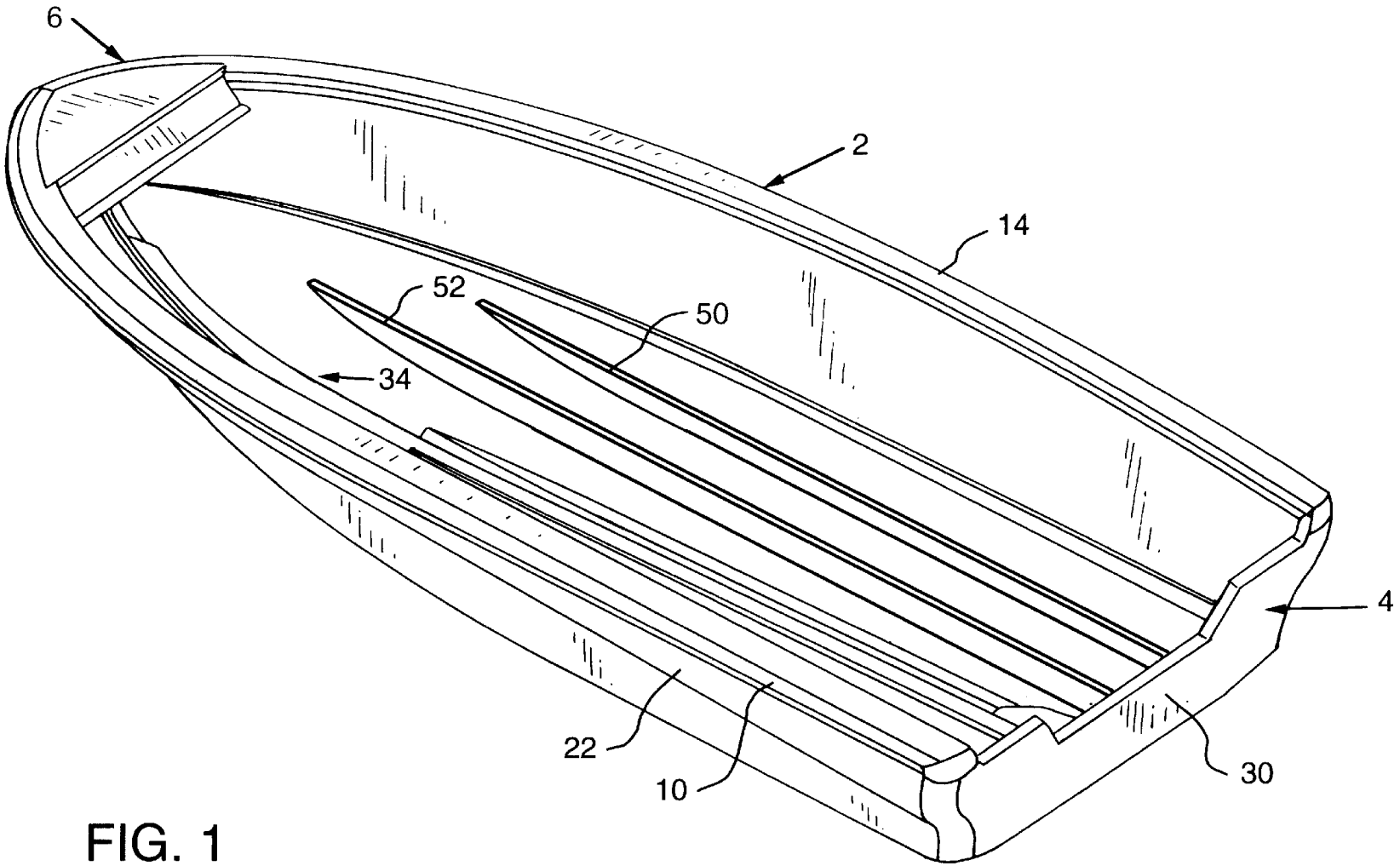
FIG. 1 is a perspective view showing the interior of a form of boat adapted for use of the reinforcing structure of the present invention as shown generally from the rear.
Figure 2:
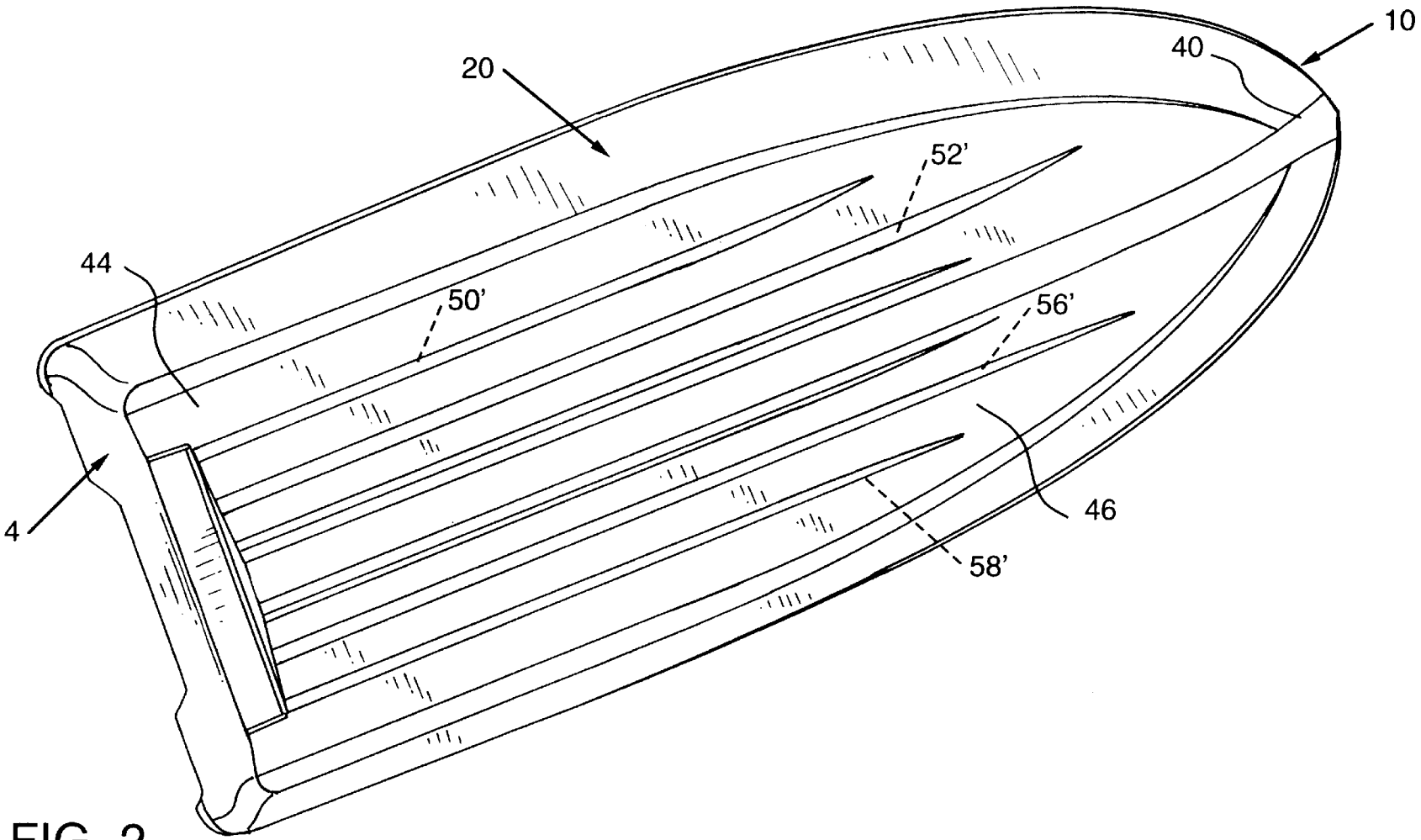
FIG. 2 is a perspective view showing the undersurface of a portion of the boat of FIG. 1.

Referring to FIGS. 1 and 2, there is shown a performance boat 2 which has a transom 4, a bow 6, gunwale portions 10, 14 and sidewalls 20, 22. The gunwale portions 10, 14 have rear portions adjacent opposite lateral sides of the transom 4 and meet at the bow at 6.

An outboard engine or engines (not shown) generally will be secured to an upper central portion 30 of the transom 4. Outboard-inboard engines are secured adjacent to central portions of the transom. The propeller projects downwardly therefrom into the water. The boat has a generally centrally located longitudinally extending keel 34 which has its rear end adjacent to the transition from the keel 34 to transom 4 and its forward portion joined to the gunwale at 40. Also shown in this view are the hull portions 44, 46. Each hull section, in the form shown, has a pair of longitudinal extending stringers on each side of the keel 34. Hull portion 44 has stringers 50, 52 which terminate short of the keel and are generally parallel thereto. Similarly, hull portion 46 has stringers 56, 58 which are generally parallel to the keel and terminate short of the forward most portion of the keel. In FIG. 2, the members 50' 52', 56', 58' are employed to indicate the 50, 52, 56, 58 positions of the stringers which would not be visible from the undersurface, although strakes which are hull portions covering the stringers would be visible.

Figure 3:
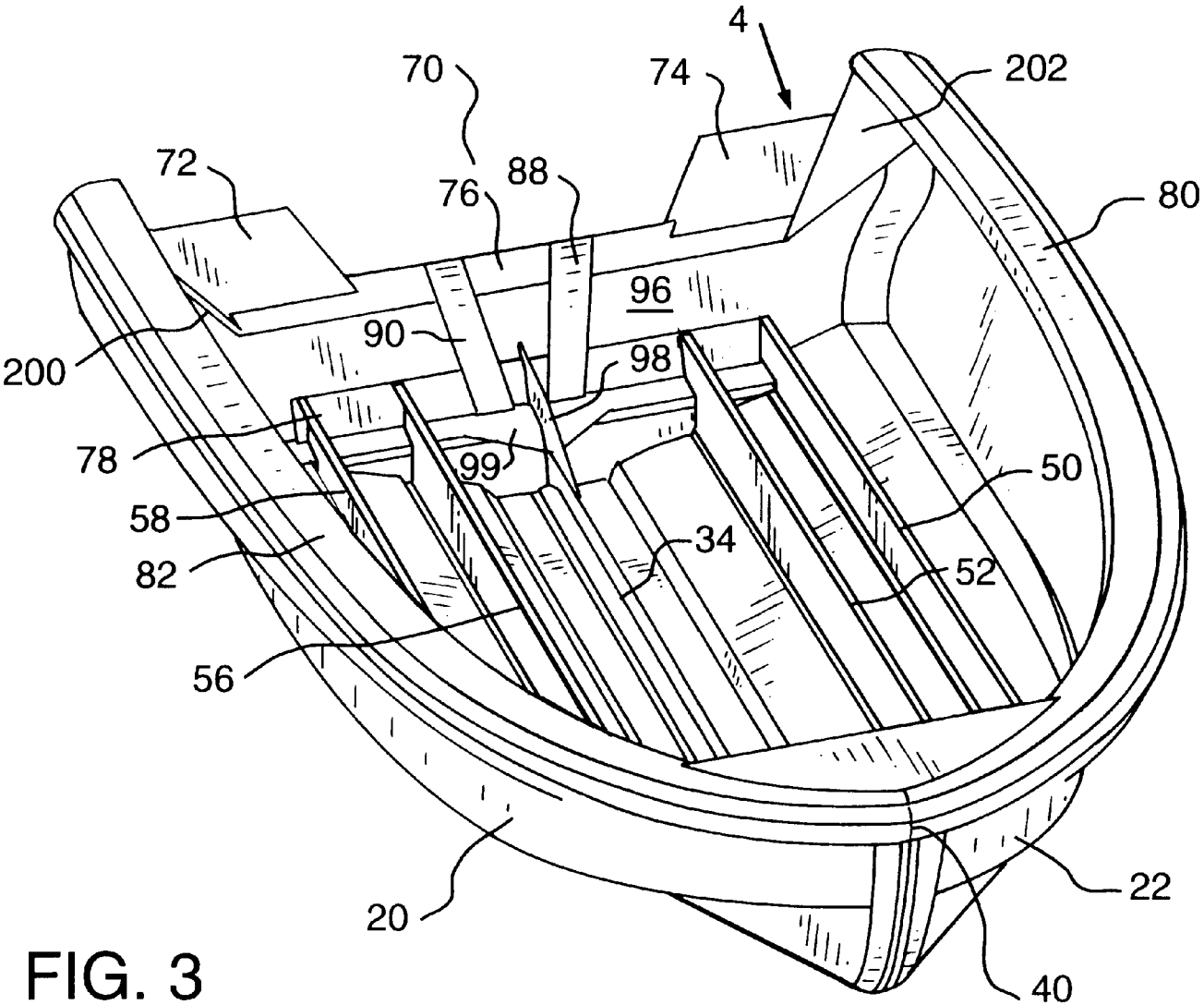
FIG. 3 is a fragmentary perspective viewed from above and forward of the boat.

Referring to FIG. 3, it is seen that the upper surface of the transom 4 defines a generally centrally located upwardly open recess 70 between lateral portions 72, 74. An upper generally transversely oriented structural member 76 has its ends gull wing plates 200, 202 secured to the gunwale portions 80, 82. Generally horizontally oriented structural member 78 generally underlies upper member 76. In the form shown, a pair of generally vertically extending structural members 88, 90 are secured respectively to the upper structural member 76 and the lower structural member 78. These structural members 76, 78, 88, 90 are preferably elongated and substantially rigid and hollow. They may, for example, be made of metal extrusions or through forming of metal, such as aluminum, as by press braking or roll forming, for example. The generally vertically extending structural members 88, 90 may be secured to the upper and lower structural members by any suitable means such as welding or mechanical fasteners or adhesives to establish a generally rigid frame which will function to effectively transfer loads imposed on the transom to other portions of the vessel. If desired, a single structural member may be provided to perform the same function as members 88, 90. For example, a unitary plate having ribbed reinforcement could be used.

A suitable aluminum alloy for use in this environment would be an alloy selected from the 6xxx series and preferably 6022-T6. Foam 96 is interposed between the upper and lower structural members 76, 78, plate 98 serves to secure the keel 34 to the transom.

Stringers 56, 58 and 50, 52 may have their rearmost ends secured to lower structural member 78 as does the transom-to-keel attachment plate 98 with reinforcement plate 99 welded to plate 98 and structural member 78. In this manner, loads applied to the transom 4 will have a portion distributed to the keel 34 and stringers 50, 52, 56, 58. Similarly, loads applied to the upper structural member 76 will be transmitted to the gunwale portions 80, 82. In this manner, both static loads from the weight of the marine engine and dynamic loads as a result of movement of the powerboat through the water will be distributed throughout the vessel.

As shown in FIG. 3 which shows the interior of a portion of the powerboat with the deck or liner removed, the loads which are transmitted to the gunwale portions 80, 82, the keel 34 and stringers 50, 52, 56, 58 are distributed to portions of the powerboat which are generally longitudinally extending. The forwardmost portions of the gunwale 80, 82 are secured to the forward most portion of the keel 34 in the bow region. The generally vertically oriented structural members 88, 90 serve to provide a rigid connection between the upper structural member or truss 76 and the lower structural member or truss 78. In the embodiment illustrated, the upper structural member 76 has a greater longitudinal extent than the lower structural member 82.

The bottom of the hull 44, 46, transom 4, and sidewalls 20, 22 are preferably made of aluminum sandwich panels with aluminum skins and an interposed foam. The overall thickness of this sandwich panel may vary from about a minimum of 0.5 inch to a maximum of about one to two feet depending on the portion of the powerboat being considered. The foam also serves as a load-transferring component in the composite sandwich panel. The foam may be made of any suitable material such as polyurethane, polystyrene and polypropylene. If desired, the transom 4 and other portions may be made of a single thickness aluminum plate which may, for example, have a thickness of greater than 0.090 inch.

Referring to FIGS. 4–9, FIG. 4 shows portions of the structural elements as viewed from the front and slightly above of the transom (not shown). The generally vertically oriented trusses 88, 90 in the form shown extend outwardly from a true vertical by angle A which is preferably about 10 to 14 degrees and shall be considered for ease of disclosure to be "generally vertical." It will be appreciated that as a result of the four structural members 76, 78, 88, 90 and their relative rigid interconnection, loads imposed on the transom will be transferred by the structural members 76, 78, 88, 90, and gull wing plates 200, 202 to the gunwale portions 80, 82, the keel 34 and the stringers 50, 52, 56, 58.

Figure 8:
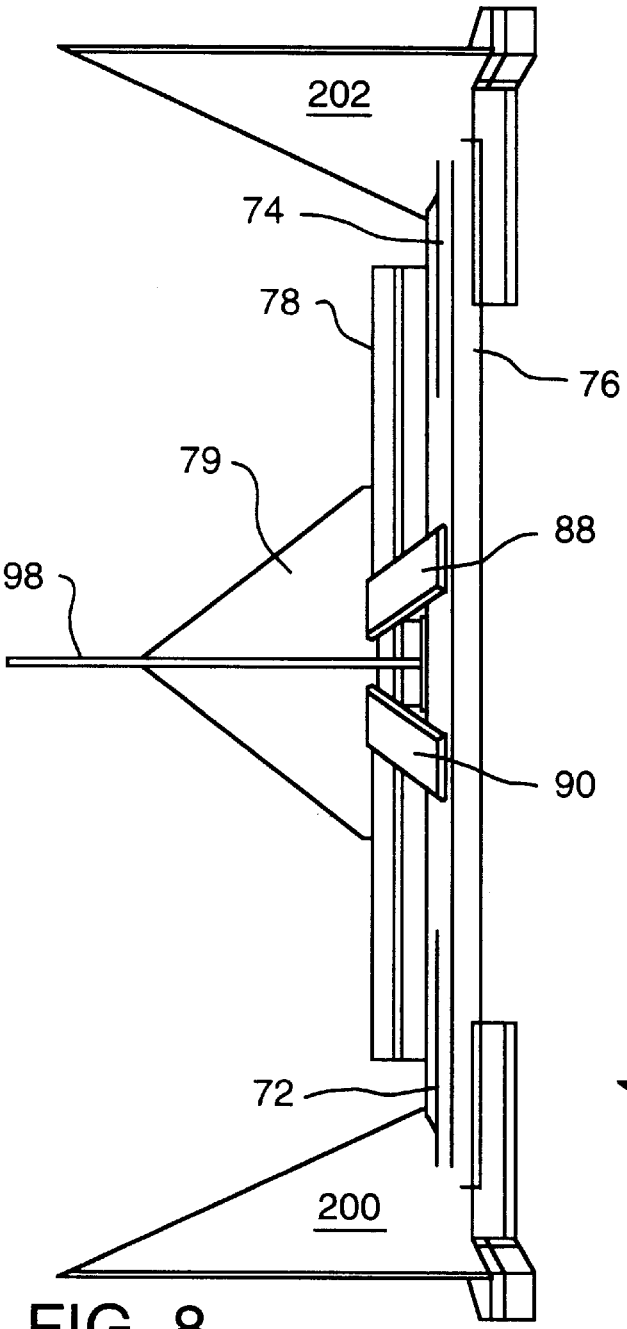
FIG. 8 is a top plan view of a portion of the transom reinforcement.
Figure 9:
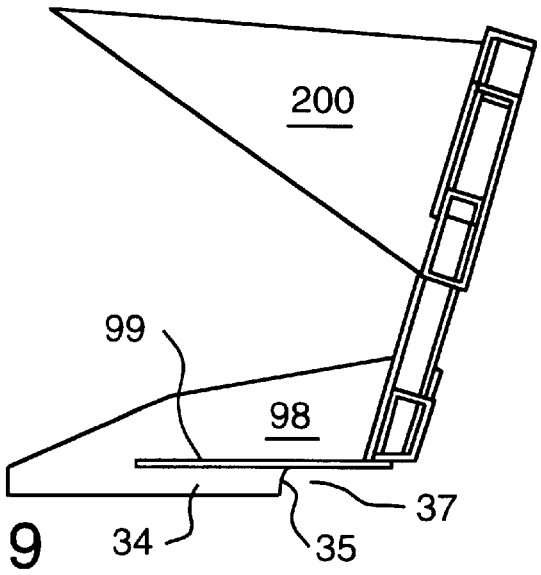
FIG. 9 is a side elevational view partly in section of a portion of the transom.

As shown in FIG. 9, the keel 34 and stringers (not shown in this view) may have rearmost end 35 which is a step 37 in the hull which serves to provide a functional shortening of the boat. The transom in the form shown slopes rearwardly. As a result, as shown in FIG. 8, structural member 78 is disposed forwardly of structural member 76.

Figure 6:
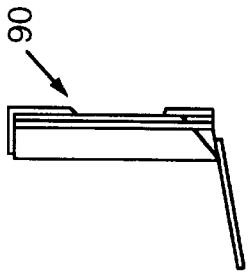
FIG. 6 is a cross-sectional illustration taken through 6—6 of FIG. 4.
Figure 7:
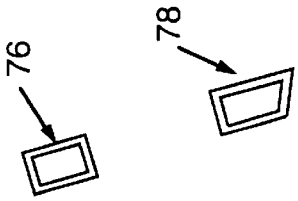
FIG. 7 is a cross-sectional illustration taken through 7—7 of FIG. 4.
Figure 4:
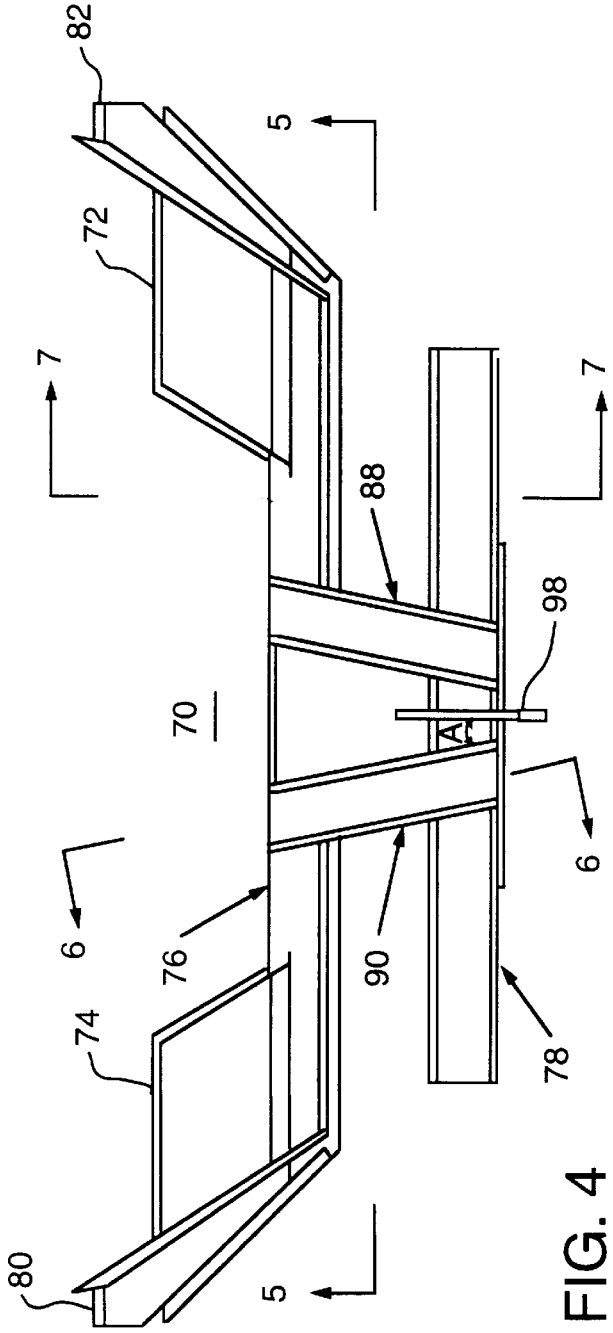
FIG. 4 is a partially schematic elevational view showing a portion of the transom reinforcing structure of the present invention.
Figure 5:
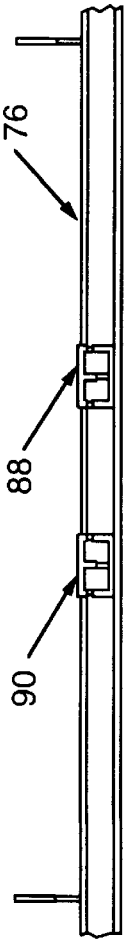
FIG. 5 is a cross-sectional view taken through 5—5 of FIG. 4.

It will be appreciated, as shown in FIG. 5 and 6, that the trusses 88, 90 are generally hollow. Also, the upper structural member 76 and lower structural member 78 are of generally rectangular or trapezoidal configuration and hollow or of generally open profile such as a channel or hat shape. For convenience of reference herein, all such hollow and non-solid profiles will be referred to as "hollow shapes."

Figure 10:
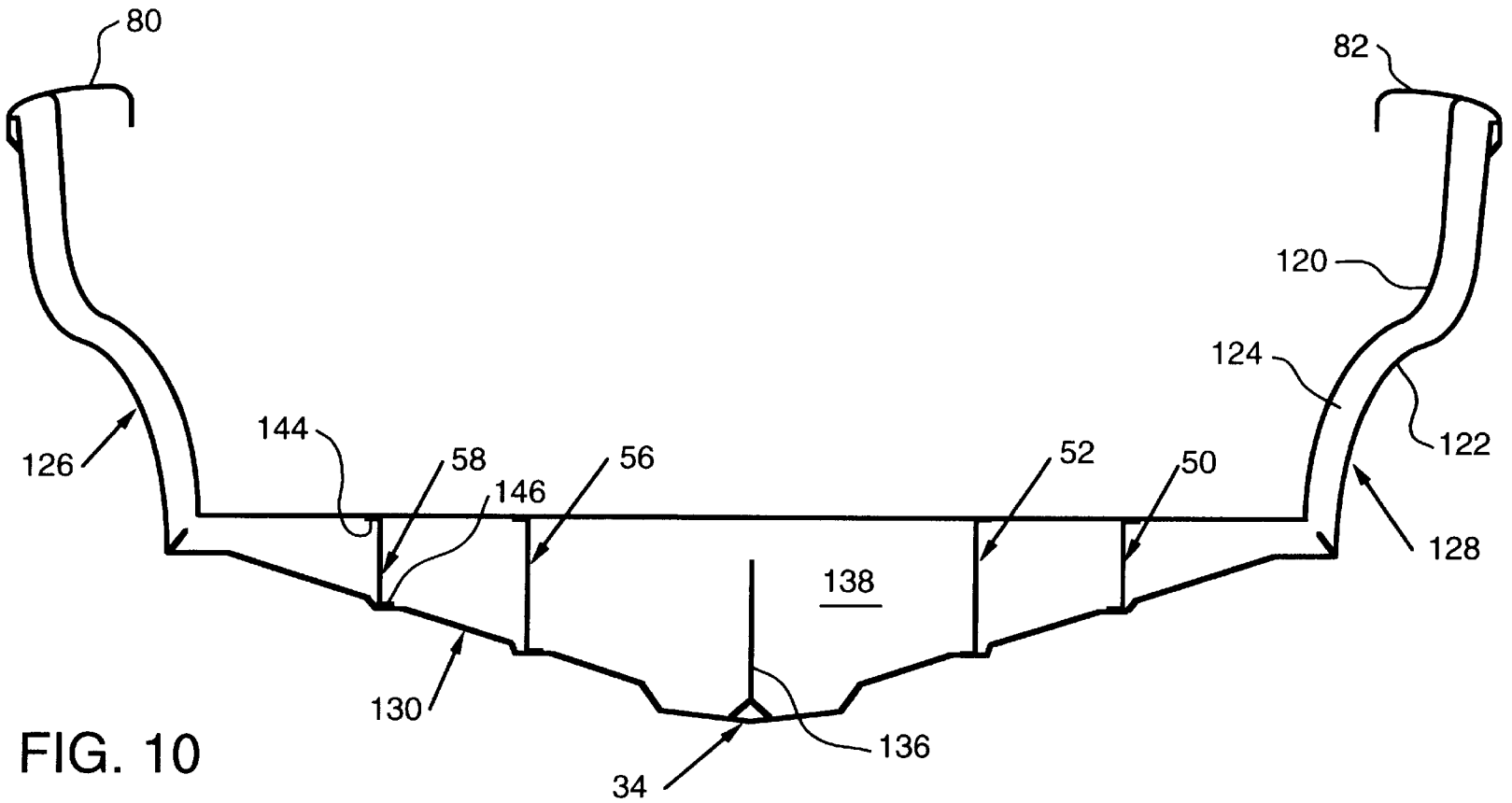
FIG. 10 is a partially schematic transverse cross-sectional illustration, a form of the present invention.

Referring now to FIG. 10, as shown in this view the gunwale portions 80, 82 cooperate with the sandwich portion which consists of an inner aluminum liner 120 and an outer portion 122 with a foam plastic 124 interposed. The aluminum portions 120, 122 are preferably formed by stretch forming and are secured within suitable fixtures to create the sandwich construction by the foaming of the resinous material. It will be noted that the sidewalls may be integrally formed with the lower hull portion 130 or may be formed separately and joined to each other as by welding, for example. The keel 34 has a lower portion and an upper portion 136 imbedded within the foam material 138. A plurality of stringers such as 50, 52, 56, 58 extend longitudinally and are also secured within the foam 138. The stringers 50, 52, 56, 58 in the form shown are generally parallel to each other and are positioned with a pair of stringers 50, 52 or 56, 58 on opposite sides of the keel 34. In the form shown, the stringers are of generally z-shape and have an upper flange such as 144 in stringer 58 secured in intimate contact with aluminum skin 120 and a lower flange 146 secured to a generally flat portion of the lower skin 122. It will be appreciated that other configurations may be employed, if desired. The stringers 50, 52, 56, 58 may be secured in place by mechanical fasteners or adhesives.

It will be appreciated that the structural members 76, 78, 88, 90 will be embedded within the foam portion of the transom and form part of the aluminum-foam-aluminum sandwich. In lieu of a cast in situ foam, a preformed plastic or plywood insert may be employed.

While in the preferred form the stringers 50, 52, 56, 58 will be oriented generally longitudinally with respect to the length of the boat, they may be angularly or transversely oriented, if desired. Also, if desired, combinations of such orientations may be employed.

It will be appreciated from the foregoing that the present invention provides a unique reinforcing assembly for the transom of a powerboat which is suitable for use in high performance powerboats. This may support an outboard engine, the outdrive of an inboard-outboard engine and/or other parts of the boat. All of this accomplished in a manner which is consistent with conventional methods of manufacture of boats, does not alter the appearance thereof while functioning to efficiently and economically transfer loads imposed on the transom to a number of structurally sound portions of the boat.

Also, the transom and hull portions, and sidewall portions may be of either aluminum-resin-aluminum or single thickness aluminum construction.

While for purposes for convenience of disclosure herein, reference has been made to the use of aluminum and particular preferred alloys for the structural reinforcing members 76, 78, 88, 90, the invention is not so limited. Other aluminum alloys and other metals, as well as resinous plastics, may be employed advantageously. For example, chopped fiberglass in a suitable matrix over a wooden member could be employed. Also, while reference has been made to bass and walleye boats, the invention is not so limited.

Whereas particular embodiments of the invention have been described above for purposes of illustration, it will be evident to those skilled in the art that numerous variations of the details may be made without departing from the invention as defined in the appended claims.

What is claimed is:

1. A powerboat having a hull, a transom, keel, sidewalls and a gunwale, an engine secured to said powerboat, an upper generally transversely oriented structural member secured to said transom, a lower generally transversely oriented structural member secured in generally underlying relationship with respect to said upper generally transversely oriented structural member, at least one generally vertically oriented structural member secured to said transverse structural members, said hull having a keel and at least one stringer on each side of said keel, said upper generally transverse structural member being structured to transfer a transom load directly to said gunwales, and said lower generally transverse structural member being structured to transfer load to said keel and/or at least one of said stringers.

2. The powerboat of claim 1 including said hull being composed of an aluminum outer skin, an aluminum inner skin, and a resinous foam secured therebetween.

3. The powerboat of claim 1 including said transverse structural members being of generally hollow shape.

4. The powerboat of claim 3 including said vertical structural members being of generally hollow shape.

5. The powerboat of claim 1 including said transverse structural members being aluminum extrusions.

6. The powerboat of claim 1 including said transverse structural members being formed aluminum members.

7. The powerboat of claim 1 including said generally vertical structural members being aluminum extrusions.

8. The powerboat of claim 1 including said generally vertical structural members being formed of aluminum.

9. The powerboat of claim 1 including said generally transverse structural members and said generally vertical structural members serving to direct loads imposed by the weight of said engine to said gunwales, said keel and said stringers.

10. The powerboat of claim 1 including employing two said generally vertically oriented structural members.

11. The powerboat of claim 2 including said aluminum skins being made from a 6xxx aluminum alloy.

12. The powerboat of claim 1 including said lower generally transverse structural member being secured to said keel and said stringers.

13. The powerboat of claim 12 including said stringers having a lower portion secured to said hull and an upper portion secured to a deck liner.

14. The powerboat of claim 13 including said keel being secured to said hull.

15. The powerboat of claim 1 including said boat being a bass boat.

16. The powerboat of claim 1 including said boat being a walleye boat.

17. The powerboat of claim 1 including said keel secured to said gunwale in the bow of said boat.

18. The powerboat of claim 2 including said foam having a thickness varying from about 0.5 inch to about 2 feet.

19. A powerboat comprising a hull, a transom, keel, sidewalls and a gunwale, an engine secured to said powerboat, an upper generally transversely oriented structural member secured to said transom, a lower generally transversely oriented structural member secured in generally underlying relationship with respect to said upper generally transversely oriented structural member, at least one generally vertically oriented structural member secured to said transverse structural members, said hull having a keel and at least one stringer on each side of said keel, said upper generally transverse structural member being structured to transfer a transom load to said gunwales, said lower generally transverse structural member being structured to transfer load to said keel and/or at least one of said stringers, and said upper structural member having a greater longitudinal extent than said lower structural member.

20. The powerboat of claim 19 including said structural members being substantially rigid.

21. The powerboat of claim 1 including said generally vertically oriented structural members being secured to said generally transversely oriented structural members by welding.

22. A powerboat having a hull, a transom, sidewalls and gunwales, a first generally rigid elongated structural member secured to said transom in direct load transmitting relationship with respect to said gunwales, said hull having a keel and at least two stringers, a second generally rigid elongated structural member secured to said transom in load transmitting relationship with respect to said keel and/or at least one of said stringers, and a generally rigid third structural member secured to said first structural member and said second structural member.

23. The powerboat of claim 22 including said first structural member, said second structural member and said third structural member each being of generally hollow shape and substantially rigid.

24. The powerboat of claim 23 including said second structural member generally underlying said first structural member.

25. The powerboat of claim 24 including a generally rigid fourth structural member secured to said first structural member and said second structural member.

26. The powerboat of claim 22 including said hull being a stretch formed aluminum hull.

27. The powerboat of claim 26 including said hull having a stretch formed aluminum hull section and a stretch formed liner section with an interposed resinous foam material.

28. The powerboat of claim 27 including said aluminum being a 6xxx alloy.

* * * * *